United States Patent [19]

Ogata et al.

[11] Patent Number: 4,687,713

[45] Date of Patent: Aug. 18, 1987

[54] TIN-FREE STEEL STRIPS USEFUL IN THE MANUFACTURE OF WELDED CANS AND PROCESS FOR MAKING

[75] Inventors: Hajime Ogata; Hisatada Nakakouji; Yasuhiro Akeda; Toshio Ichida; Toshio Irie; Sachiko Otsuka, all of Chiba, Japan

[73] Assignee: Kawasaki Steel Corporation, Kobe, Japan

[21] Appl. No.: 842,521

[22] Filed: Mar. 14, 1986

[30] Foreign Application Priority Data

Mar. 15, 1985 [JP] Japan ..... 60-52935
Jun. 8, 1985 [JP] Japan ..... 60-124847

[51] Int. Cl.[4] ..... B32B 15/04

[52] U.S. Cl. ..... 428/628; 428/666; 428/687; 204/41; 204/56.1

[58] Field of Search ..... 428/628, 666, 687; 204/41, 56 R

[56] References Cited

U.S. PATENT DOCUMENTS 4,432,842 2/1984 Inui et al. ..... 204/56 R

FOREIGN PATENT DOCUMENTS 453027 1/1973 Australia .
473353 7/1974 Australia .
0101871 3/1984 European Pat. Off. .
0132722 7/1984 European Pat. Off. .
0121817 10/1984 European Pat. Off. .
60-24399 7/1985 Japan .

OTHER PUBLICATIONS

Patent Abstracts of Japan, Unexamined Applications, C Field, vol. 9, No. 153, Jun. 27, 1985, Kokai No. 60-29 494, p. 18, C 288, "Production of Tin-Free Steel Having Excellent Paint Adhesion".

*Primary Examiner*—L. Dewayne Rutledge
*Assistant Examiner*—George Wyszomibrski
*Attorney, Agent, or Firm*—Young & Thompson

[57] ABSTRACT

A tin-free steel strip comprising a steel strip, 40 to 150 mg/m$^2$ of a metallic chromium layer on the steel surface, and 5 to 25 mg/m$^2$ of a chromium compound containing layer thereon wherein the metallic chromium layer contains a plurality of protrusions, exhibits improved corrosion resistance and weldability and is thus useful in the manufacture of welded cans. Preferably, $1\times10^{11}$ to $1\times10^{14}$ protrusions having a diameter of 5 to 1000 nm at the base thereof are present per square meter of the metallic chromium layer surface. The tin-free steel strip is produced by chromium plating a steel strip in an aqueous solution containing $CR^{6+}$ preferably to a weight of 40 to 140 mg/m$^2$, subjecting the chromium plated strip to anodic electrolysis, preferably at an eectricity quantity of 0.1 to 10 C/dm$^2$, and subjecting the strip to a cathodic treatment in an aqueous solution containing $Cr^{6+}$ and a chromium plating aid so as to deposit additional metallic chromium, preferably in a weight of 10 to 60 mg/m$^2$.

2 Claims, 9 Drawing Figures

TIN-FREE STEEL STRIPS USEFUL IN THE MANUFACTURE OF WELDED CANS AND PROCESS FOR MAKING

BACKGROUND OF THE INVENTION

This invention relates to tin-free steel strips useful in the manufacture of welded cans finding applications as food cans, beverage cans, 18-liter cans, pail cans, and other commercial cans.

The most widely used can-forming materials are generally tinplate and tin-free steel. For the reasons of resource saving, cost saving, and appearance, tinplate cans have been progressively converted from soldered cans to welded cans. At the same time, the weight of tin coating has been reduced, that is, tin plates having as thin as 1.0 g/m$^2$ or less of tin coating have been developed instead of conventional heavily plated ones having 2.8 g/m$^2$ or more of tin. From the standpoint of economy, however, it does not appear that lightly coating tinplate is superior to tin-free steel. This is one of the reasons of the increasing use of tin-free steel.

Despite the economic advantage, the tin-free steel suffers from a severe problem. More particularly, tin-free steel strips are steel strips having thin coatings of metallic chromium and chromium compounds (usually hydrated chromium oxides) on the surface. In order to avert its own drawbacks that it can be neither soldered nor welded because of the high electric resistance and high melting point of the surface coatings, tin-free steel is, for the most part, used as cemented cans.

Such cemented cans, however, encounter the trouble of can barrel rupture. That is, cemented seals can be broken during high temperature sterilization of can contents. Irrespective of some recent improvements accomplished by the modification of the hydrated chromium oxide coating of tin-free steel, cemented cans are always liable to such a danger. If a weldable tin-free steel strip is developed, not only the rupture trouble could be avoided, but the overlapping distance at a bond could be reduced from about 5 mm required for cementing to about 0.2 to 0.4 mm for welding, leading to a material saving. Also, the risk of vacuum leakage from crimped portions can be prevented. Thus there is a great need for the development of a weldable tin-free steel strips.

Weldable tin-free steel strips and processes for their preparation are known in the art as disclosed in Japanese Patent Publication Nos. 57-19752 and 57-36986. These prior art techniques improve weldability by reducing the amount of metallic chromium or chromium compounds at the sacrifice of corrosion resistance because the resultant metallic chromium layer on such tin-free steel inevitably becomes porous in structure.

SUMMARY OF THE INVENTION

It is, therefore, an object of the present invention to provide a novel and improved tin-free steel strip having improved corrosion resistance and suitable for use as welded cans.

Another object of the present invention is to provide a process for producing the improved tin-free steel strip in an economic and consistent manner.

According to a first aspect of the present invention, there is provided a tin-free steel strip useful in the manufacture of welded cans, comprising a steel strip having a surface, a metallic chromium layer formed on the steel surface to a weight of 40 to 150 mg/m$^2$, and a non-metallic chromium layer formed on the metallic chromium layer to a weight of 5 to 25 mg/m$^2$, wherein the metallic chromium layer has protrusions on its surface adjoining the non-metallic chromium layer.

According to a second aspect, the present invention is directed to a process for producing a tin-free steel strip useful in the manufacture of welded cans, comprising a steel strip having a surface, a metallic chromium layer formed on the steel surface to a weight of 40 to 150 mg/m$^2$, and a chromium compound containing layer formed on the metallic chromium layer to a weight of 5 to 25 mg/m$^2$, wherein the metallic chromium layer has protrusions on its surface adjoining the non-metallic chromium layer. The tin-free steel strip is produced by the steps of chromium plating a steel strip in an aqueous solution containing hexavalent chromium ions, subjecting the chromium plated strip to an electrolytic treatment with the strip being made anode, and subjecting the strip to a cathodic treatment in an aqueous solution containing a chromium plating aid and hexavalent chromium ions.

According to a third aspect, there is provided a tin-free steel strip useful in the manufacture of welded cans, comprising a steel strip having a surface, a metallic chromium layer formed on the steel surface to a weight of 40 to 150 mg/m$^2$, and a chromium compound containing layer formed on the metallic chromium layer to a weight of 5 to 25 mg/m$^2$, wherein the metallic chromium layer has $1\times10^{11}$ to $1\times10^{14}$ protrusions per square meter on its surface adjoining the non-metallic chromium layer, the protrusions having a diameter of 5 to 1000 nm at the base thereof.

According to a fourth aspect, there is provided a process for producing a tin-free steel strip useful in the manufacture of welded cans, comprising a steel strip having a surface, a metallic chromium layer formed on the steel surface to a weight of 40 to 150 mg/m$^2$, and a chromium compound containing layer formed on the metallic chromium layer to a weight of 5 to 25 mg/m$^2$, wherein the metallic chromium layer has $1\times10^{11}$ to $1\times10^{14}$ protrusions per square meter on its surface adjoining the chromium compound containing layer, said protrusions having a diameter of 5 to 1000 nm at the base thereof, said process comprising the steps of chromium plating a cold rolled steel strip in an aqueous solution containing hexavalent chromium ions to a weight of 40 to 140 mg/m$^2$ of metallic chromium, subjecting the chromium plated strip to an electrolytic treatment at an electricity quantity of 0.1 to 10 C/dm$^2$ with the strip being made anode, and subjecting the strip to a cathodic treatment in an aqueous solution containing a chromium plating aid and hexavalent chromium ions so as to deposit an additional metallic chromium layer in a weight of 10 to 60 mg/m$^2$.

DETAILED DESCRIPTION OF THE INVENTION

The tin-free steel strips of the present invention includes a metallic chromium layer formed on the surface of a steel strip to a weight of 40 to 150 mg/m$^2$. A chromium compound containing layer is formed on the metallic chromium layer to a weight of 5 to 25 mg/m$^2$. The metallic chromium layer has a plurality of protrusions on its surface adjoining the chromium compound containing layer. The surface of the metallic chromium layer having protrusions is herein also referred to as a partially protuberant surface. The present tin-free steel strips exhibit improved corrosion resistance and weldability and are thus satisfactory steel stock from which cans are formed by welding.

Figure 1:
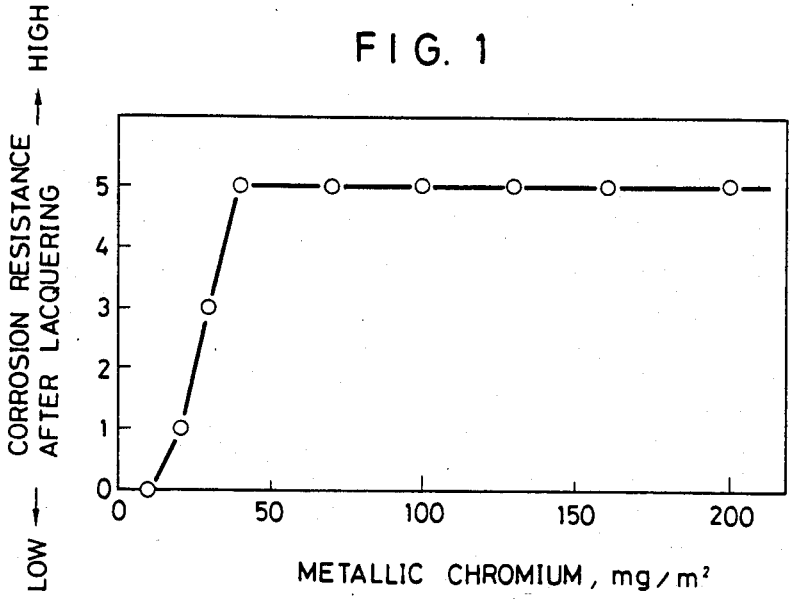
FIG. 1 is a diagram showing the corrosion resistance after lacquering of tin-free steel strips as a function of the weight of metallic chromium deposited.
Figure 2:
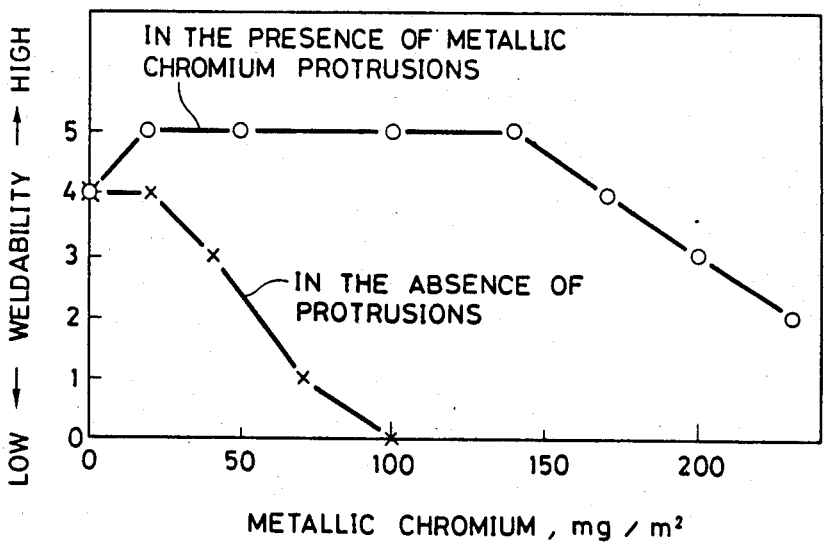
FIG. 2 is a diagram showing the weldability of tin-free steel strips as a function of the weight of metallic chromium deposited.

The weight of metallic chromium deposited is limited to the range from 40 to 150 mg/m$^2$ for the following reason. Metallic chromium layers consisting of less than 40 mg/m$^2$ of metallic chromium are porous in structure and can not fully cover the steel surface, resulting in a reduced corrosion resistance after lacquering as seen from FIG. 1 (the evaluation of corrosion resistance after lacquering will be described later). Excessively large amounts of metallic chromium beyond 150 mg/m$^2$ seem to provide no additional improvement in corrosion resistance after lacquering and detract from weldability as seen from FIG. 2 (the evaluation of weldability will be described later). For these reasons, the amount of metallic chromium deposited in the practice of the present invention is limited to the range from 40 to 150 mg/m$^2$.

Figure 3A:
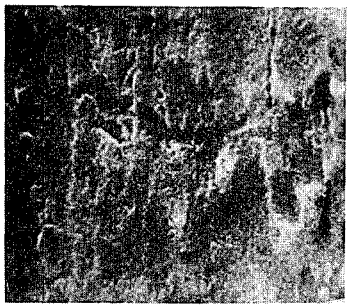
FIG. 3a PRIOR ART
FIGS. 3*a* and 3*b* are electron photomicrographs (8000X) on the surface of metallic chromium layers, FIG. 3*a* showing a flat surface and FIG. 3*b* showing a partially protuberant surface.
Figure 3B:
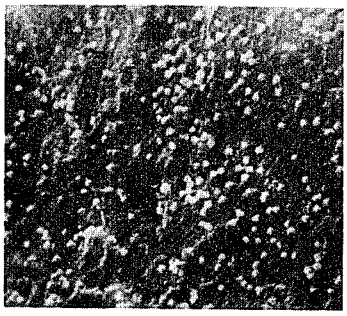

The metallic chromium layer according to the present invention has a partially protuberant surface, that is, a surface containing a plurality of protrusions on the side remote from the underlying steel. As seen from FIG. 2, a metallic chromium layer having such a partially protuberant surface as shown in FIG. 3*b* exhibits superior weldability to a metallic chromium layer having a flat or smooth surface as shown in FIG. 3*a*.

Figure 4:
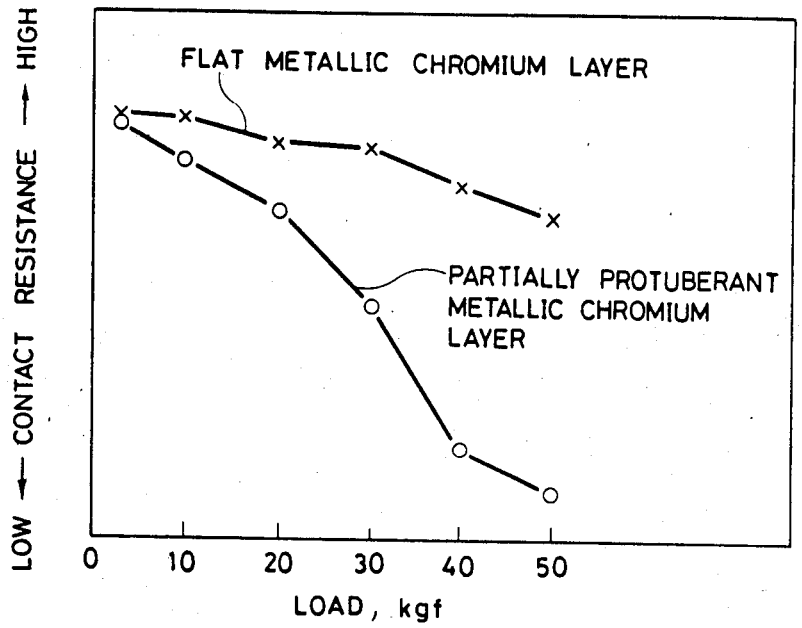
FIG. 4 is a diagram showing the contact resistance vs. load of strips having metallic chromium layers having a flat surface and a partially protuberant surface.

It is contact resistance that predominantly governs electric resistance welding on a tin-free steel strip having such metallic and chromium compound containing layers. The lower the contact resistance, the better is the weldability. A test was carried out by applying a pressure onto the chromium layers of a strip through a copper wire electrode and measuring the contact resistance while varying the pressure. The contact resistance reduces with an increase in the pressure applied through the copper wire electrode. Both a tin-free steel strip having a flat metallic chromium layer and a tin-free steel strip having a partially protuberant metallic chromium layer were examined for contact resistance under varying loads, with the results shown in FIG. 4. Although the contact resistance reduces with the increasing load for both the strips, the extent of contact resistance reduction is greater in the case of the latter strip having a partially protuberant metallic chromium layer. It is believed that with a certain load applied, the protrusions of hard metallic chromium pierce the overlying non-conductive layer of softer chromium compounds to form paths available for electric conduction.

Figure 5:
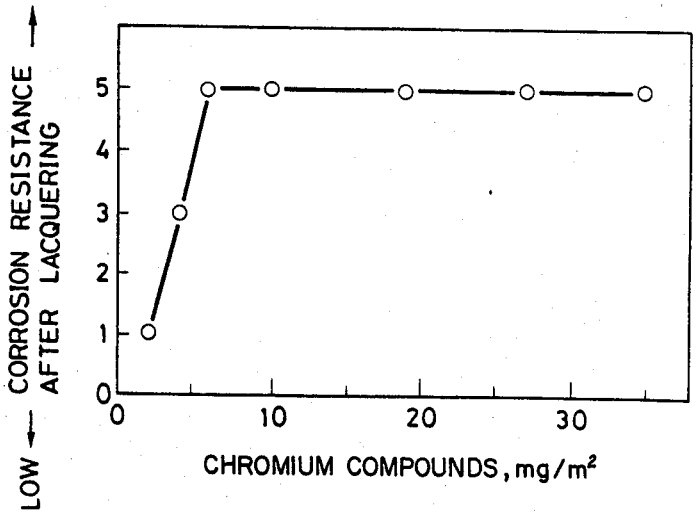
FIG. 5 is a diagram showing the corrosion resistance after lacquering of tin-free steel strips as a function of the weight of chromium compounds deposited.
Figure 6:
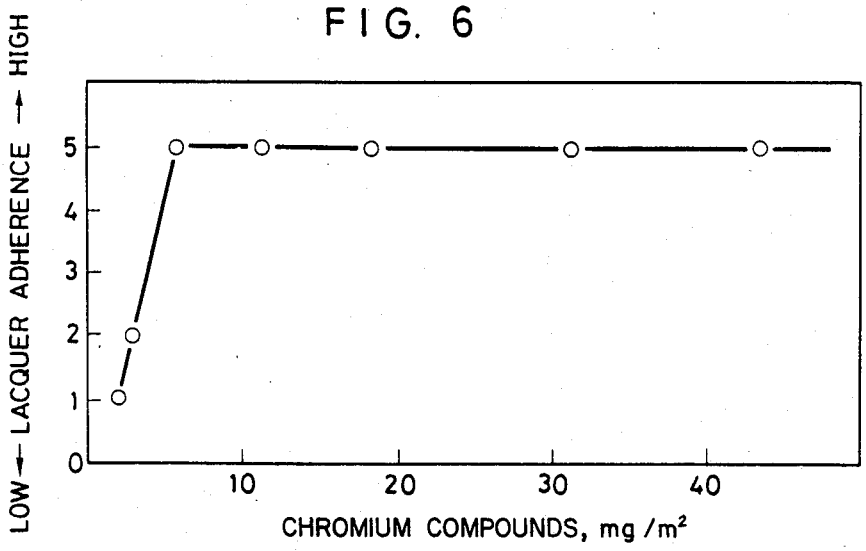
FIG. 6 is a diagram showing the lacquer adherence to tin-free steel strips as a function of the weight of non-metallic chromium deposited.
Figure 7:
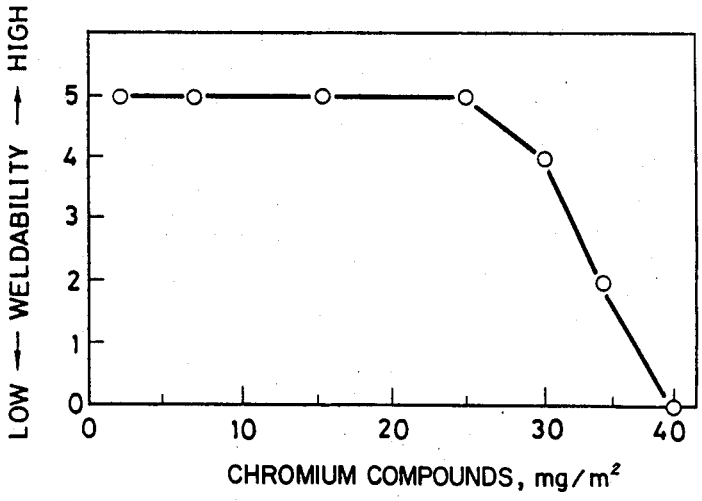
FIG. 7 is a diagram showing the weldability of tin-free steel strips as a function of the weight of non-metallic chromium deposited.

The weight of chromium compounds deposited is limited to the range from 5 to 25 mg/m$^2$ calculated as metallic chromium for the following reason. Weights of less than 5 mg/m$^2$ of chromium compounds result in porous layers which cannot fully cover the steel surface, detracting from corrosion resistance after lacquering and lacquer adherence as seen from FIGS. 5 and 6, respectively. Weldability is remarkably reduced when the weight of chromium compounds exceeds 25 mg/m$^2$ as seen from FIG. 7. It appears that metallic chromium protrusions cannot break through exceedingly thick chromium compound containing layers which are non-conductive.

As understood from the foregoing, tin-free steel strips having a partially protuberant metallic chromium layer in a weight of 40 to 150 mg/m$^2$ and a chromium compound containing layer in a weight of 5 to 25 mg/m$^2$ on a steel surface are satisfactory can-forming steel strips exhibiting improved corrosion resistance and weldability.

Next, a method for producing the present tin-free steel strips suitable for the manufacture of welded cans in an economic and consistent manner will be described.

The phenomenon that metallic chromium is deposited as a layer having protrusions of round or angular particulate shape is sometimes observed when chromium plating is discontinuously carried out. Once electrolysis is interrupted, a chromium compound containing layer on a metallic chromium undergoes a microscopic disproportionate dissolution, which causes anomalous deposition of metallic chromium during subsequently restarted electrolysis. The process which depends on the microscopic disproportionate dissolution of a chromium compound containing layer is, however, difficult to consistently produce a metallic chromium layer having protrusions. There occur substantial variations of the deposition of such a partially protuberant metallic chromium layer in the width direction of a steel strip. This process is thus unacceptable in an industrial practice.

Searching for a commercially practicable process capable of microscopic disproportionate dissolution of non-metallic chromium in a stable manner, we have found that anodic treatment or reverse electrolysis in an aqueous solution containing hexavalent chromium cations functions well for the purpose. This is applicable to both the single and double electrolyte chromating processes. The essential features of the present invention are that metallic and chromium compound containing layers are present prior to an anodic treatment and that the anodic treatment is followed by a cathodic treatment of depositing metallic chromium.

The deposition of metallic chromium after the anodic treatment may be accomplished by cathodic electrolysis in an aqueous solution containing hexavalent chromium cations ($Cr^{6+}$) and a chromium plating aid which may be selected from compounds capable of producing sulfate ions and fluoride ions. The most preferred sulfate ion-producing compound is sulfuric acid although other known sulfates may be used. Examples of the fluorides include $Na_2SiF_6$, $NaBF_4$, and NaF. No metallic chromium will deposit during cathodic electrolysis in a similar aqueous solution containing hexavalent chromium cations, but free of a chromium plating aid. The aqueous solution containing hexavalent chromium cations may be any of aqueous solutions containing at least one member of chromic acid, dichromic acid, and salts thereof as a main ingredient.

In the tin-free steel strip useful in the manufacture of welded cans, comprising a steel strip having a surface, a metallic chromium layer formed on the steel surface to a weight of 40 to 150 mg/m$^2$, and a chromium compound containing layer formed on the metallic chromium layer to a weight of 5 to 25 mg/m$^2$, according to the third aspect of the present invention, the metallic chromium layer has $1\times10^{11}$ to $1\times10^{14}$ protrusions per square meter on its surface adjoining the chromium compound containing layer. The protrusions are of a round or angular (polygonal) shape and have a diameter of 5 to 1000 nm at the base thereof. These steel strips are more improved in corrosion resistance and weldability.

Since the weights of metallic and chromium compound containing layers are limited for the same reasons as mentioned above, the shape factors of protrusions will be described in detail.

Partially protuberant metallic chromium layers on tin-free steel strips are known in the art as reported by an article entitled "Study on anomalous tone on tin-free steel surface" in Iron and Steel, Vol. 66 (1980), page 218. This article describes an improvement in anomalous tone from the standpoint that protrusions on a metallic chromium layer cause anomalous tone. Continuing our research work, we have found that weldability and corrosion resistance are best improved by controlling various factors of protrusions including shape, diameter, and density.

Figure 8:
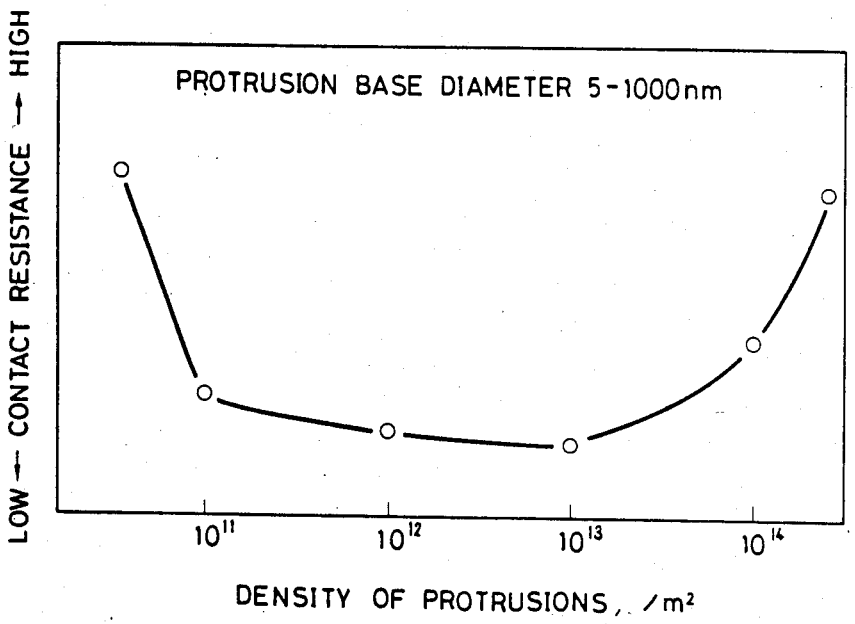
FIG. 8 is a diagram showing the relationship of contact resistance to the density of protrusions.

The shape of protrusions may be an angular (polygonal) or round particulate shape in cross section although the exact shape varies depending on various parameters in the depositing process. To ensure weldability, the protrusions should have a diameter of 5 nm or greater at the base thereof, that is, on the major surface of the metallic chromium layer. When the protrusions are as large as having a diameter of greater than 1000 nm at the base, the overlying non-metallic layer is liable to breakage under a relatively low load and thus, corrosion resistance is deteriorated during handling of steel strips. The density or population of protrusions should fall within the range from $1\times10^{11}$ to $1\times10^{14}$ per square meter to provide weldability as seen from FIG. 8. Protrusion densities of lower than $1\times10^{11}$/m$^2$ are too less to fully reduce contact resistance. Too many protrusions in excess of $1\times10^{14}$/m$^2$ are interconnected or bridged to one another to offer a contact resistance similar to that obtained from a smooth metallic chromium layer.

An economic process for producing such a tin-free steel strip for use in the manufacture of welded cans will now be described.

According to the feature of the present invention, chromium plating is first carried out to deposit 40 to 140 mg/m$^2$ of a metallic chromium layer and an amount of a non-metallic chromium layer on at least one surface of a steel strip. An electrolytic treatment is then carried out at an electricity of 0.1 to 10 C/dm$^2$ (coulomb/square decimeter), with the steel strip made anode. Subsequently, a cathodic electrolysis is carried out in an aqueous solution containing hexavalent chromium ions ($Cr^{6+}$) and a chromium plating aid selected from sulfates and fluorides to deposit 10 to 60 mg/m$^2$ of metallic chromium in addition to the original metallic chromium layer.

Prior to the anodic treatment, metallic and non-metallic chromium layers are uniformly formed on a steel strip to improve the corrosion resistance thereof. The subsequent anodic treatment induces the microscopic disproportionate dissolution of the chromium compound containing a stable manner. In the last chromium plating assisted by the chromium plating aid, metallic chromium is anomalously deposited to improve weldability without sacrificing corrosion resistance.

More particularly, the chromium plating prior to the anodic treatment is for the purpose of minimizing exposed parts of a steel strip to increase the corrosion resistance thereof. This chromium plating process is not particularly limited and may be selected from any conventional chromium electroplating processes.

The amount of metallic chromium deposited during the initial chromium plating is limited to the range from 40 to 140 mg/m$^2$. Metallic chromium layers of less than 40 mg/m$^2$ are too porous in structure to fully cover the steel surface, resulting in a loss of lacquer adherence. When the initial amount of metallic chromium exceeds 140 mg/m$^2$, the final range of 40 to 150 mg/m$^2$ of metallic chromium would be overrun by the subsequent deposition of 10 mg/m$^2$ or more of additional metallic chromium after the anodic treatment. As previously indicated, simply subjecting a steel strip to chromium plating would result in the formation of a smooth metallic chromium layer. Thus, according to the present invention, the chromium plating is followed by anodic electrolysis, that is, electrolytic treatment at an electricity of 0.1 to 10 C/dm$^2$ with the steel strip made anode and then by cathodic electrolysis in an aqueous solution containing hexavalent chromium cations ($Cr^{6+}$) and a chromium plating aid selected from sulfate ions and fluorides such as $Na_2SiF_6$, $NaBF_4$, and NaF whereby 10 to 60 mg/m$^2$ of additional metallic chromium is anomalously deposited to form $1\times10^{11}$ to $1\times10^{14}$/m$^2$ protrusions of metallic chromium having a diameter of 5 to 1000 nm at the base thereof.

An electricity of less than 0.1 C/dm$^2$ supplied during the anodic treatment is not enough to induce the microscopic disproportionate dissolution of the non-metallic chromium layer. An exceedingly greater electricity of more than 10 C/dm$^2$ would provide no additional effect while increasing the cost.

The essential role of the cathodic treatment subsequent to the anodic treatment is to deposit metallic chromium. Metallic chromium may be deposited by carrying out cathodic electrolysis in an aqueous solution containing as a main ingredient a chromium member capable of producing hexavalent chromium cations ($Cr^{6+}$) selected from chromic acid, dichromic acid, and salts thereof, and a chromium plating aid selected from sulfate residues and fluorides such as $Na_2SiF_6$, $NaBF_4$, and NaF. The amount of metallic chromium anomalously deposited during the last cathodic treatment is in the range from 10 to 60 mg/m$^2$ because amounts of less than 10 mg/m$^2$ are insufficient for protrusions to grow. Depositing more than 60 mg/m$^2$ of additional metallic chromium results in coarse protrusions. By depositing 10 to 60 mg/m$^2$ of additional metallic chromium after the anodic treatment, there are produced $1\times10^{11}$ to $1\times10^{14}$/m$^2$ protrusions of metallic chromium having a diameter of 5 to 1000 nm at the base thereof.

By successively carrying out chromium plating/anodic electrolysis/cathodic electrolysis steps under the above-mentioned conditions, there are finally deposited a metallic chromium layer having a build-up of 40 to 150 mg/m$^2$ and a non-metallic chromium layer having a build-up of 5 to 25 mg/m$^2$.

EXAMPLES

In order that those skilled in the art will better understand the practice of the present invention, examples are given below along with comparative examples.

EXAMPLE 1

A cold rolled steel strip of 0.2 mm thick was degreased and pickled in a conventional manner before entering the present process.

The steel strip was subjected to cathodic electrolysis in an aqueous solution containing 150 grams/liter of $CrO_3$, 6 grams/liter of $Na_2SiF_6$ and 0.8 grams/liter of $H_2SO_4$ at 50° C. at a current density of 50 A/dm$^2$ for 1.0 second, then to an anodic treatment in the same solution at a current density of 5 A/dm$^2$ for 0.4 seconds, and finally to a cathodic treatment in an aqueous solution containing 60 grams/liter of $CrO_3$ and 0.3 grams/liter of $H_2SO_4$ at 40° C. at a current density of 15 A/dm$^2$ for 0.8 seconds, producing a tin-free steel strip. The strip had 105 mg/m$^2$ of metallic chromium and 18 mg/m$^2$ of chromium compounds deposited thereon and was observed to contain numerous protrusions of metallic chromium.

EXAMPLE 2

A cold rolled steel strip of 0.22 mm thick was degreased and pickled in a conventional manner before entering the present process.

The steel strip was subjected to cathodic electrolysis in an aqueous solution containing 80 grams/liter of $CrO_3$ and 0.6 grams/liter of $H_2SO_4$ at 45° C. at a current density of 40 A/dm$^2$ for 0.6 seconds, then to an anodic treatment in the same solution at a current density of 10 A/dm$^2$ for 0.1 second, and finally to a cathodic treatment in the same solution at a current density of 40 A/dm$^2$ for 0.3 seconds, producing a tin-free steel strip. The strip had 52 mg/m$^2$ of metallic chromium and 8 mg/m$^2$ of chromium compounds deposited thereon and was observed to contain numerous protrusions of metallic chromium.

EXAMPLE 3

A cold rolled steel strip of 0.2 mm thick was degreased and pickled in a conventional manner before entering the present process.

The steel strip was subjected in an aqueous solution containing 250 grams/liter of $CrO_3$ and 2.5 grams/liter of $H_2SO_4$ at 50° C. to cathodic electrolysis at a current density of 50 A/dm$^2$ for 0.7 seconds, successively to an anodic treatment at a current density of 15 A/dm$^2$ for 0.1 second, and again to a cathodic treatment at a current density of 50 A/dm$^2$ for 0.7 seconds. It was finally subjected to a cathodic treatment in an aqueous solution containing 60 grams/liter of $CrO_3$ and 2.8 grams/liter of $Na_2SiF_6$ at a current density of 20 A/dm$^2$ for 0.5 seconds, producing a tin-free steel strip. The strip had 141 mg/m$^2$ of metallic chromium and 20 mg/m$^2$ of chromium compounds deposited thereon and was observed to contain numerous protrusions of metallic chromium.

COMPARATIVE EXAMPLE 1

The procedure of Example 1 was repeated except that the anodic treatment was omitted. The resulting tin-free steel strip had 110 mg/m$^2$ of metallic chromium and 16 mg/m$^2$ of chromium compounds deposited thereon and was observed to contain no protrusions on the metallic chromium layer.

COMPARATIVE EXAMPLE 2

The procedure of Example 1 was repeated until the end of the anodic treatment. The final cathodic treatment was carried out in an aqueous solution containing 60 grams/liter of $CrO_3$ at 40° C. at a current density of 15 A/dm$^2$ for 0.8 seconds. The resulting tin-free steel strip had 100 mg/m$^2$ of metallic chromium and 18 mg/m$^2$ of chromium compounds deposited thereon and was observed to contain no protrusions on the metallic chromium layer.

COMPARATIVE EXAMPLE 3

A cold rolled steel strip of 0.2 mm thick was degreased and pickled in a conventional manner.

The steel strip was subjected to discontinuous cathodic electrolysis in an aqueous solution containing 50 grams/liter of $CrO_3$, 2.4 grams/liter of $Na_2SiF_6$, and 20 grams/liter or $Na_2Cr_2O_7$ at 50° C. first at a current density of 40 A/dm$^2$ for 0.2 seconds and then at a current density of 15 A/dm$^2$ for 0.3 seconds, producing a tin-free steel strip. The strip had 15 mg/m$^2$ of metallic chromium and 17 mg/m$^2$ of chromium compounds deposited thereon and was observed to contain no protrusions of metallic chromium.

The thus obtained tin-free steel strips were evaluated for corrosion resistance after lacquering and weldability by the test methods which will be described later.

The results are shown in Table 1.

The tin-free steel strips from Examples 1 to 3 satisfying all the requirements of the present invention displayed excellent corrosion resistance after lacquering and weldability. The strip from Comparative Example 1 wherein no anodic treatment was carried out displayed poor weldability because of the absence of metallic chromium protrusions. The strip from Comparative Example 2 wherein the cathodic treatment after the anodic treatment was carried out in an aqueous solution free of a chromium plating aid displayed poor weldability because of the absence of metallic chromium protrusions. The strip from Comparative Example 3 which contained as little as 15 mg/m$^2$ of metallic chromium had fair weldability and noticeably poor corrosion resistance after lacquering.

The corrosion resistance after lacquering and weldability are evaluated as follows.

Corrosion resistance after lacquering

A tin-free steel strip sample was coated with an epoxyphenol lacquer composition in a coating weight of 50 mg/dm$^2$ followed by baking. The lacquered sample was immersed in 100 ml of tomato juice in a 150-ml beaker at 95° C. while the upper sample portion was kept above the liquid level. The entire beaker was sealed and shelf stored at 55° C. for 18 days. The sample was removed and examined for the degree of corrosion under the lacquer coating above the liquid level. The degree of corrosion was evaluated in six grades from 0 to 5 according to the following criterion.

| Grade | Observation |
|---|---|
| 5 | No corrosion occurred under lacquer coating |
| 0 | Lacquer coating peeled off over the entire surface above the liquid level |

Grades 1, 2, 3, and 4 are evaluated intermediate grades 0 and 5 in this order.

Weldability

Tin-free steel samples were baked at 210° C. for 20 minutes without any coating. Electric resistance welding was carried out at a welding speed of 40 m/min. under an applied pressure of 40 kgf. For each sample, welding conditions were determined where a weld having a sufficient strength was obtained and the number of splashes of 1 mm or larger is minimum. Evaluation was made by the number of splashes under the conditions.

| Point | Number of splashes per 10 cm |
|---|---|
| 5 | 0 |
| 4 | 1–2 |
| 3 | 3–5 |
| 2 | 6–10 |
| 1 | 11–20 |
| 0 | 21 or more |

TABLE 1

| Sample | Metallic chromium $mg/m^2$ | Chromium compounds $mg/m^2$ | Metallic chromium protrusion | Corrosion resistance | Weldability |
|---|---|---|---|---|---|
| E1 | 105 | 12 | numerous | 5 | 5 |
| E2 | 52 | 8 | numerous | 5 | 5 |
| E3 | 141 | 20 | numerous | 5 | 5 |
| CE1 | 110 | 16 | none | 5 | 0 |
| CE2 | 100 | 8 | none | 5 | 0 |
| CE3 | 15 | 7 | none | 1 | 4 |

EXAMPLE 4

A cold rolled steel strip of 0.2 mm thick was degreased and pickled in a conventional manner before entering the present process.

The steel strip was subjected to cathodic electrolysis in an aqueous solution containing 150 grams/liter of $CrO_3$, 5 grams/liter of $Na_2SiF_6$ and 0.6 grams/liter of $H_2SO_4$ at 50° C. at a current density of 60 $A/dm^2$ for 0.1 second, then to an anodic treatment in the same solution at a current density of 5 $A/dm^2$ for 0.5 seconds, and finally to a cathodic treatment in an aqueous solution containing 60 grams/liter of $CrO_3$ and 0.3 grams/liter of $H_2SO_4$ at 40° C. at a current density of 15 $A/dm^2$ for 0.8 seconds, producing a tin-free steel strip.

The strip had 123 $mg/m^2$ of metallic chromium and 20 $mg/m^2$ of chromium compounds deposited thereon and was observed to contain numerous protrusions of metallic chromium having a diameter in the range of 5 to 1000 nm at the base thereof and distributed in a density of $5\times10^{12}/m^2$.

EXAMPLE 5

A cold rolled steel strip of 0.22 mm thick was degreased and pickled in a conventional manner before entering the present process.

The steel strip was subjected to cathodic electrolysis in an aqueous solution containing 80 grams/liter of $CrO_3$ and 2.0 grams/liter of $Na_2SiF_6$ at 50° C. at a current density of 40 $A/dm^2$ for 0.7 seconds, then to an anodic treatment in the same solution at a current density of 5 $A/dm^2$ for 0.2 seconds, and finally to a cathodic treatment in the same solution at a current density of 50 $A/dm^2$ for 0.2 seconds, producing a tin-free steel strip.

The strip had 61 $mg/m^2$ of metallic chromium and 10 $mg/m^2$ of chromium compounds deposited thereon and was observed to contain numerous protrusions of metallic chromium having a diameter in the range of 5 to 1000 nm at the base thereof and distributed in a density of $3.0\times10^{13}/m^2$.

EXAMPLE 6

A cold rolled steel strip of 0.18 mm thick was degreased and pickled in a conventional manner before entering the present process.

The steel strip was subjected in an aqueous solution containing 250 grams/liter of $CrO_3$ and 2.5 grams/liter of $H_2SO_4$ at 50° C. to cathodic electrolysis at a current density of 70 $A/dm^2$ for 0.5 seconds, successively to an anodic treatment at a current density of 15 $A/dm^2$ for 0.5 second, and again to a cathodic treatment at a current density of 70 $A/dm^2$ for 0.3 seconds. It was finally subjected to a cathodic treatment in an aqueous solution containing 60 grams/liter of $CrO_3$ and 1.5 grams/liter of $Na_2SiF_6$ at a current density of 20 $A/dm^2$ for 0.5 seconds, producing a tin-free steel strip.

The strip had 149 $mg/m^2$ of metallic chromium and 24 $mg/m^2$ of chromium compounds deposited thereon and was observed to contain numerous protrusions of metallic chromium having a diameter in the range of 5 to 1000 nm at the base thereof and distributed in a density of $1.0\times10^{13}/m^2$.

COMPARATIVE EXAMPLE 4

The procedure of Example 4 was repeated except that the anodic treatment was omitted, that is, discontinuous electrolysis was carried out.

The resulting strip had 135 $mg/m^2$ of metallic chromium and 19 $mg/m^2$ of chromium compounds deposited thereon and was observed to contain protrusions of metallic chromium having a diameter in the range of 100 to 2000 nm at the base thereof and distributed in a density of $5\times10^{10}/m^2$.

COMPARATIVE EXAMPLE 5

The procedure of Example 5 was repeated until the end of the anodic treatment. The final cathodic treatment was carried out in an aqueous solution containing 60 grams/liter of $CrO_3$ at 40° C. at a current density of 20 $A/dm^2$ for 0.6 seconds. The resulting strip had 92 $mg/m^2$ of metallic chromium and 15 $mg/m^2$ of chromium compounds deposited thereon and was observed to contain no protrusions on the metallic chromium layer.

COMPARATIVE EXAMPLE 6

A cold rolled steel strip of 0.2 mm thick was degreased and pickled in a conventional manner.

The steel strip was subjected in an aqueous solution containing 50 grams/liter of $CrO_3$, 2.4 grams/liter of $Na_2SiF_6$, and 20 grams/liter of $Na_2Cr_2O_7$ at 50° C. to cathodic electrolysis at a current density of 40 $A/dm^2$ for 0.9 seconds, then to an anodic treatment at a current density of 20 $A/dm^2$ for 0.7 seconds, and again to a cathodic treatment at a current density of 70 $A/dm^2$ for 0.7 seconds, producing a tin-free steel strip.

The strip had 130 mg/m$^2$ of metallic chromium and 25 mg/m$^2$ of chromium compounds deposited thereon and was observed to contain protrusions of metallic chromium having a diameter in the range of 10 to 100 nm at the base thereof and distributed in a density of $4\times10^{14}$/m$^2$.

The thus obtained tin-free steel strips were evaluated for lacquer adherence and contact resistance by the test methods which will be described later.

The results are shown in Table 2.

The tin-free steel strips from Examples 4 to 6 satisfying all the requirements of the present invention displayed excellent lacquer adherence and low contact resistance. The strip from Comparative Example 4 displayed poor lacquer adherence because there were present a smaller number of metallic chromium protrusions having a larger base diameter. The strip from Comparative Example 5 wherein the cathodic treatment after the anodic treatment was carried out in an aqueous solution free of a chromium plating aid displayed a high contact resistance because of the absence of metallic chromium protrusions. The strip from Comparative Example 6 which contained as many as $4\times10^{14}$/m$^2$ protrusions of metallic chromium had a high contact resistance approximate to that of a smooth chromium layer.

The lacquer adherence and contact resistance are evaluated as follows.

Lacquer adherence (L.A.)

A tin-free steel strip sample was coated with an epoxyphenol paint composition followed by baking to a dry weight of 50 mg/dm$^2$ on each surface. The coated sample was immersed in a 3% NaCl aqueous solution and retorted therein at a temperature of 110° C. for 120 minutes. Cross cuts were formed in the coating with a knife. An adhesive tape was applied to the cross-cut coating surface and then peeled off to determine the separation of the coating. The lacquer adherence was evaluated in terms of the coating separation in six grades from 0 to 5 according to the following criterion.

| Grade | Observation |
|---|---|
| 5 | No coating separated |
| 0 | Substantial separation |

Grades 1, 2, 3, and 4 are evaluated intermediate grades 0 and 5 in this order.

Contact resistance (C.R.)

A tin-free steel strip was heat treated at a temperature of 210° C. for 20 minutes. Two pieces having a diameter of 100 mm were punched out of the strip, placed one on another, and interposed between a pair of roller electrodes via a copper wire. The contact resistance was measured by applying a load of 40 kgf to the assembly. The results are expressed by qualitative evaluation as high and low.

TABLE 2

| Sample | Metallic chromium mg/m$^2$ | Chromium compounds mg/m$^2$ | Diameter nm | Density/m$^2$ | L.A. | C.R. |
|---|---|---|---|---|---|---|
| E4 | 125 | 20 | 50-1000 | $5\times10^{12}$ | 5 | low |
| E5 | 61 | 10 | 5-100 | $3\times10^{13}$ | 5 | low |
| E6 | 149 | 24 | 50-1000 | $1\times10^{12}$ | 5 | low |
| CE4 | 135 | 19 | 100-2000 | $5\times10^{10}$ | 2 | low |
| CE5 | 92 | 15 | -0 | -0 | 5 | high |
| CE6 | 130 | 25 | 10-100 | $4\times10^{14}$ | 5 | high |

*Diameter: Diameter of protrusion base
Density: Number of protrusions per square meter As evident from the data of Examples and the description preceding the examples, the tin-free steel strips of the present invention exhibit excellent corrosion resistance after lacquer coating because a metallic chromium layer which is dense rather than porous as encountered in the prior art entirely covers the steel surface, and excellent weldability because the metallic chromium layer has protrusions. They are thus very suitable for the manufacture of welded cans.

The present process carries out the reverse electrolysis or anodic treatment of the initially deposited chromium layer to remove undesirable anions entrained therein, contributing to an improvement in corrosion resistance after lacquer coating.

We claim:

1. A tin-free steel strip useful in the manufacture of welded cans, comprising a steel strip having a surface, a metallic chromium layer formed on the steel surface to a weight of 40 to 150 mg/m$^2$, and a chromium compound containing layer formed on the metallic chromium layer to a weight of 5 to 25 mg/m$^2$, wherein the metallic chromium layer has $1\times10^{11}$ to $1\times10^{14}$ protrusions per square meter on its surface adjoining the chromium compound containing layer, said protrusions having a diameter of 5 to 1000 nm at the base thereof.

2. A process for producing a tin-free steel strip useful in the manufacture of welded cans, comprising a steel strip having a surface, a metallic chromium layer formed on the steel surface to a weight of 40 to 150 mg/m$^2$, and a chromium compound containing layer formed on the metallic chromium layer to a weight of 5 to 25 mg/m$^2$, wherein the metallic chromium layer has $1\times10^{11}$ to $1\times10^{14}$ protrusions per square meter on its surface adjoining the chromium compound containing layer, said protrusions having a diameter of 5 to 1000 nm at the base thereof, said process comprising the steps of chromium plating a cold rolled steel strip in an aqueous solution containing hexavalent chromium ions to a weight of 40 to 140 mg/m$^2$ of metallic chromium, subjecting the chromium plated strip to an electrolytic treatment at an electricity quantity of 0.1 to 10 C/dm$^2$ with the strip being made anode, and subjecting the strip to a cathodic treatment in an aqueous solution containing a chromium plating aid and hexavalent chromium ions so as to deposit an additional metallic chromium layer in a weight of 10 to 60 mg/m$^2$.

* * * * *